US007365630B1

(12) United States Patent
Yang et al.

(10) Patent No.: US 7,365,630 B1
(45) Date of Patent: Apr. 29, 2008

(54) LOW MAGNETIC LEAKAGE HIGH VOLTAGE TRANSFORMER

(75) Inventors: Ching-Sheng Yang, Taipei (TW); Su-Hua Wu, Panchiao (TW); Yuan-Kuei Cheng, Hsin-Tien (TW)

(73) Assignee: Taipei Multipower Electronics Co., Ltd., Taipei Hsien (TW)

( * ) Notice: Subject to any disclaimer, the term of this patent is extended or adjusted under 35 U.S.C. 154(b) by 0 days.

(21) Appl. No.: 11/767,524

(22) Filed: Jun. 24, 2007

(51) Int. Cl.
*H01F 27/24* (2006.01)

(52) U.S. Cl. ..... 336/208; 336/212; 336/198

(58) Field of Classification Search ..... 336/208, 336/198, 212, 192, 65, 67
See application file for complete search history.

(56) References Cited

U.S. PATENT DOCUMENTS 4,716,394 A * 12/1987 Gordon ..... 336/192
7,116,204 B2 * 10/2006 Fushimi ..... 336/208
7,196,609 B2 * 3/2007 Wu ..... 336/208
2007/0159288 A1 * 7/2007 Chang ..... 336/212

* cited by examiner

*Primary Examiner*—Anh Mai

(57) ABSTRACT

Disclosed is a low magnetic leakage high voltage transformer in which two winding brackets are mounted in an electrically insulative holder frame to hold two primary windings and two secondary windings at two sides, two U-shaped FERRITE cores are inserted into the winding brackets from two sides and abutted against each other, and a straight FERRITE core is inserted into an insertion slot on the electrically insulative holder frame into contact with the abutted U-shaped FERRITE cores and isolated from the primary windings and the secondary windings by baffle flanges of the electrically insulative holder frame, and two electrically insulative caps are capped on the winding brackets and abutted against two opposite sides of the electrically insulative holder frame to increase the creepage distance between conducting terminals of the windings and the FERRITE cores, for enabling the secondary windings to output two high voltages stably for driving multiple loads.

7 Claims, 9 Drawing Sheets

LOW MAGNETIC LEAKAGE HIGH VOLTAGE TRANSFORMER

BACKGROUND OF THE INVENTION

1. Field of the Invention

The present invention relates to transformers and more particularly, to a low magnetic leakage high voltage transformer, which provides two output voltages to drive multiple loads.

2. Description of the Related Art

German scientist Karl Ferdinand Braun developed the first controllable CRT in 1897. However, it wasn't until the late 1940s that CRTs were used in the first television sets. Nowadays, various new display devices including TFT LCDs, PDPs, FPDs, etc. have been developed and have appeared on the market. It is predicated that TFT LCDs will soon completely take the place of CRTs on market. Currently, the backlight of a TFT LCD uses a number of CCFLs (Cold Cathode Fluorescent Lamps). In order to drive these CCFLs, each CCFL uses one respective circuit (electronic ballast). Because a CCFL discharges electricity, it produces negative resistance. When multiple CCFLs are connected in parallel to a transformer, the transformer can only turn on CCFL. Therefore, people usually put a rectifying capacitor between CCFLs and the respective transformers so that the CCFLs that are connected in parallel can be simultaneously turned on. However, because each CCFL uses a respective circuit (electronic ballast), the manufacturing cost of the TFT LCD is high, and the size of the TFT LCD cannot be reduced to meet the market trend toward light, thin, short and small.

In order to eliminate the aforesaid drawbacks, transformer manufacturers developed a one-to-multiple compact design of transformer. According to this design, a primary winding and multiple secondary windings are provided at two sides of a magnetic PATH, and a driving circuit is connected to the primary winding to provide electric energy to the primary winding, for enabling each secondary winding to output electric energy to a respective lamp via a respective capacitor. According to this design, one transformer is capable of driving multiple lamps. The use of such a transformer in a TFT LCD greatly saves the manufacturing cost and size of the TFT LCD. However, this design cannot eliminate magnetic interference between windings, and the secondary windings may output different amount of electric energy to the connected lamps, resulting in insufficient brightness of the lamps or damage to the lamps. In order to eliminate this problem, another design of high voltage transformer is developed. As illustrated in FIG. 11, the high voltage transformer comprises two electrically insulative brackets A arranged in parallel, primary windings A1 and secondary windings A2 respectively wound round the electrically insulative brackets A, and two U-shaped FERRITE cores B respectively inserted into the electrically insulative brackets A from two sides and set into abutment to form a magnetic PATH. This design of high voltage transformer can drive two lamp tubes at a time. This design of high voltage transformer uses multiple primary windings and secondary windings to drive multiple lamp tubes. However, because the windings use one common magnetic PATH, magnetic interference will occur between each two adjacent windings, resulting in unstable power output and uneven brightness of the connected lamp tubes. Further, the use of one common magnetic PATH by multiple primary windings and secondary windings will cause magnetic saturation, resulting in loss of magnetization and overheat of the FERRITE core set, and the power capacity of the high voltage transformer will drop.

Further, the arrangement of the multiple primary windings and secondary windings greatly increases the magnetic path length, resulting in a low leakage inductance and causing it unable to achieve the desired resonant frequency.

Therefore, it is desirable to provide a low magnetic leakage high voltage transformer that eliminates the aforesaid drawbacks.

SUMMARY OF THE INVENTION

The present invention has been accomplished under the circumstances in view. According to one aspect of the present invention, the low magnetic leakage high voltage transformer comprises an electrically insulative holder frame, a primary winding bracket and a secondary winding bracket mounted in the electrically insulative holder frame at two sides, a plurality of primary windings and a plurality of secondary windings respectively wound on the primary winding bracket and the secondary winding bracket, and an FERRITE core set. The FERRITE core set is comprised of two U-shaped FERRITE cores inserted into the primary winding bracket and the secondary winding bracket from two opposite sides and abutted against each other, and a straight FERRITE core inserted into an insertion slot on the top side of the electrically insulative holder frame and kept in contact with the abutted U-shaped FERRITE cores and isolated from the primary windings and the secondary windings by baffle flanges of the electrically insulative holder frame for enabling the secondary windings to output two high voltages for driving a load or loads. By means of providing one single magnetic path for the primary windings and the secondary windings, the low magnetic leakage high voltage transformer stabilizes the electric current of lamp tubes connected thereto, extending the work life of the lamp tubes. This arrangement also prevents magnetic saturation, eliminating magnetic failure or overheat, and increasing the electric power capacity of the transformer.

According to another aspect of the present invention, the baffle flanges of the electrically insulative holder frame greatly increase the creepage distance between the straight FERRITE core of the FERRITE core set and the primary windings and secondary windings, preventing short circuit.

According to still another aspect of the present invention, the secondary windings at the secondary winding bracket are induced to output a positive high voltage and a negative high voltage upon connection of an input voltage to the primary windings.

According to still another aspect of the present invention, two electrically insulative caps are capped on the primary winding bracket and the secondary winding bracket and respectively abutted against two opposite sides of the electrically insulative holder frame to increase the creepage distance between the U-shaped FERRITE cores of the FERRITE core set and conducting terminals of the primary windings and the secondary windings, conforming to the safety code and preventing short circuit.

DETAILED DESCRIPTION OF THE PREFERRED EMBODIMENT

Figure 1:
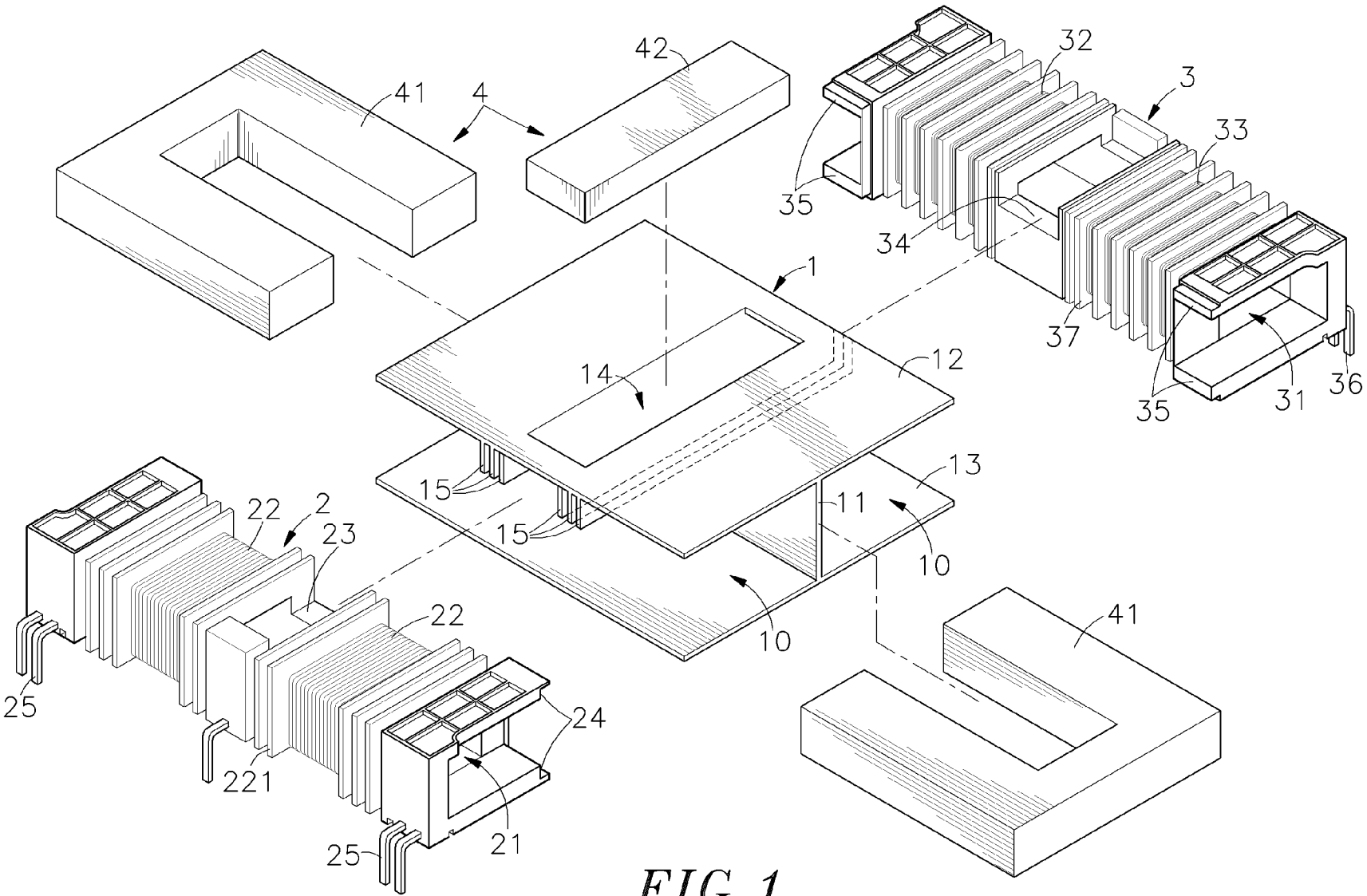
FIG. 1 is an exploded view of a low magnetic leakage high voltage transformer according to the present invention.
Figure 2:
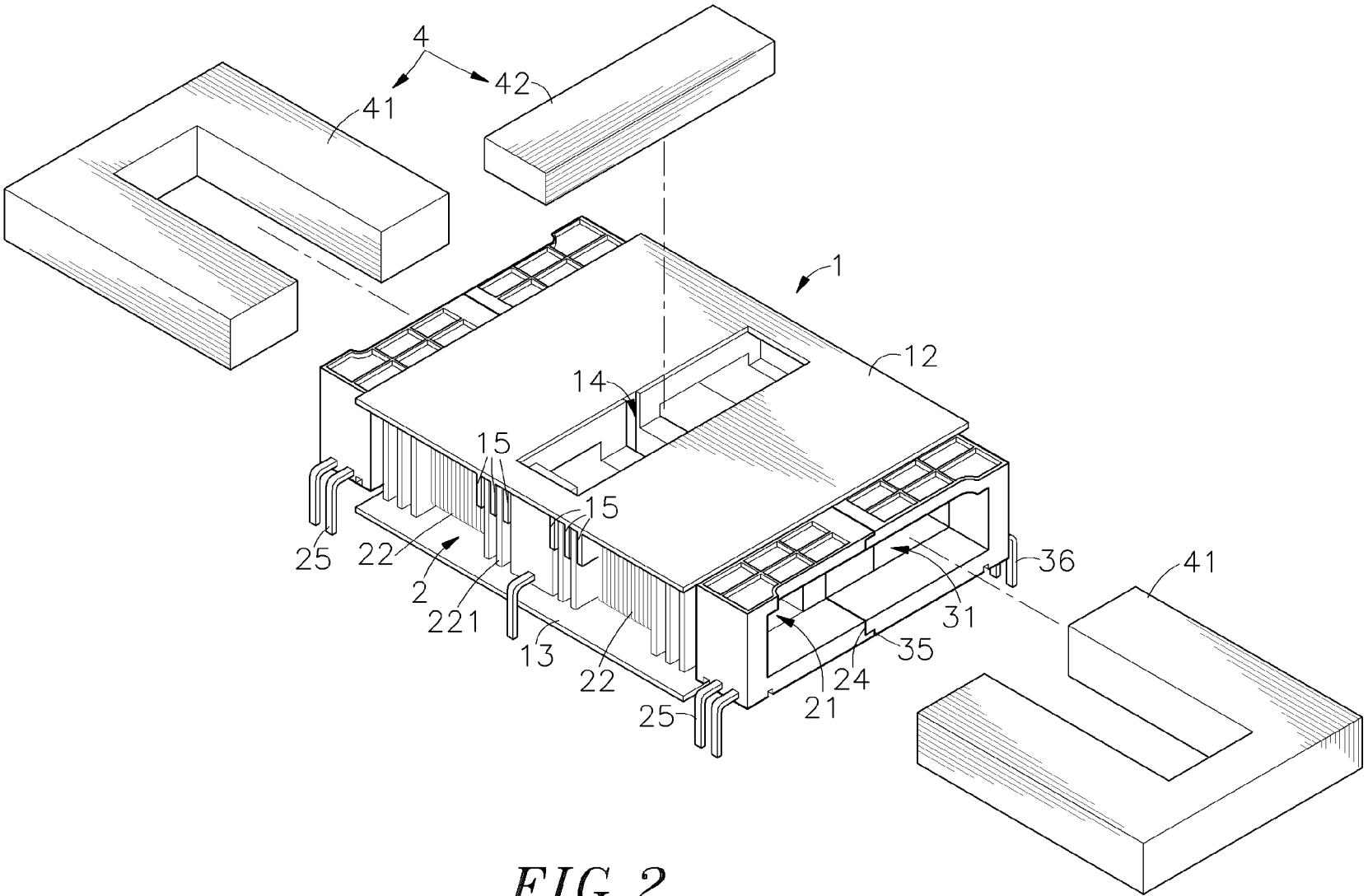
FIG. 2 is a schematic assembly view of the low magnetic leakage high voltage transformer according to the present invention.
Figure 3:
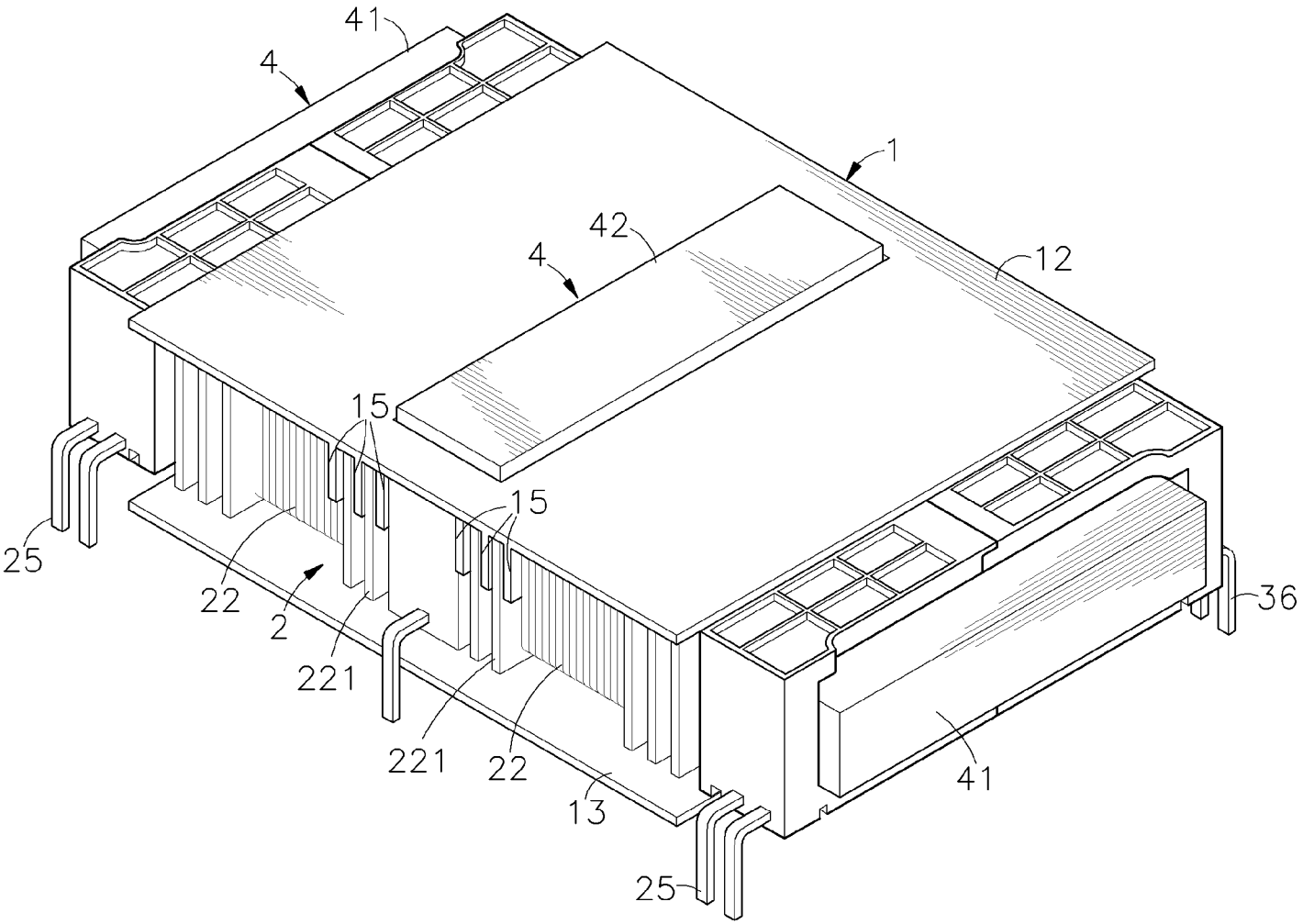
FIG. 3 is an elevational view of the low magnetic leakage high voltage transformer according to the present invention.

Referring to FIGS. 1~3, a low magnetic leakage high voltage transformer in accordance with the first embodiment of the present invention is shown comprised of an electrically insulative holder frame 1, a primary winding bracket 2, a secondary winding bracket 3 and an FERRITE core set 4.

The cross section of the electrically insulative holder frame 1 shows an I-shaped profile. Further, the electrically insulative holder frame 1 comprises a vertical middle wall 11, a horizontal top wall 12 at the top side of the vertical middle wall 11, and a horizontal bottom wall 13 at the bottom side of the vertical middle wall 11. The two horizontal top and bottom walls 12 and 13 define two receiving spaces 10 at two sides of the vertical middle wall 11. Further, the horizontal top wall 12 has an insertion slot 14 on the middle, and a plurality of baffle flanges 15 downwardly extending from the bottom surface and arranged in parallel at two sides of the insertion slot 14.

The primary winding bracket 2 has an insertion hole 21 extending through its two distal ends, two primary windings 22 wound on the periphery, partition flanges 221 extending around the periphery on the middle to keep the two primary windings 22 apart, a mounting slot 23 cut through the periphery between the partition flanges 221 in communication with the insertion hole 21, a plurality of coupling grooves 24 disposed at the two distal ends at an inner side, and a plurality of conducting terminals 25 respectively electrically connected to the primary windings 22 and suspending at an outer side.

The secondary winding bracket 3 has an insertion hole 31 extending through its two distal ends, two secondary windings 32 and 33 wound on the periphery, partition flanges 37 extending around the periphery on the middle to keep the two secondary windings 32 and 33 apart, a mounting slot 34 cut through the periphery between the partition flanges 37 in communication with the insertion hole 31, a plurality of coupling flanges 35 disposed at the two distal ends at an inner side corresponding to the coupling grooves 24 of the primary winding bracket 2, and a plurality of conducting terminals 36 respectively electrically connected to the secondary windings 32 and 33 and suspending at an outer side.

The FERRITE core set 4 is comprised of two first FERRITE cores 41 and one second FERRITE core 42. The first FERRITE cores 41 have a substantially U-shaped profile. The second FERRITE core 42 is a straight FERRITE core. Further, the first FERRITE cores 41 and the second FERRITE cores 42 can be made out of manganese zinc, nickel zinc or any other iron series material.

Figure 4:
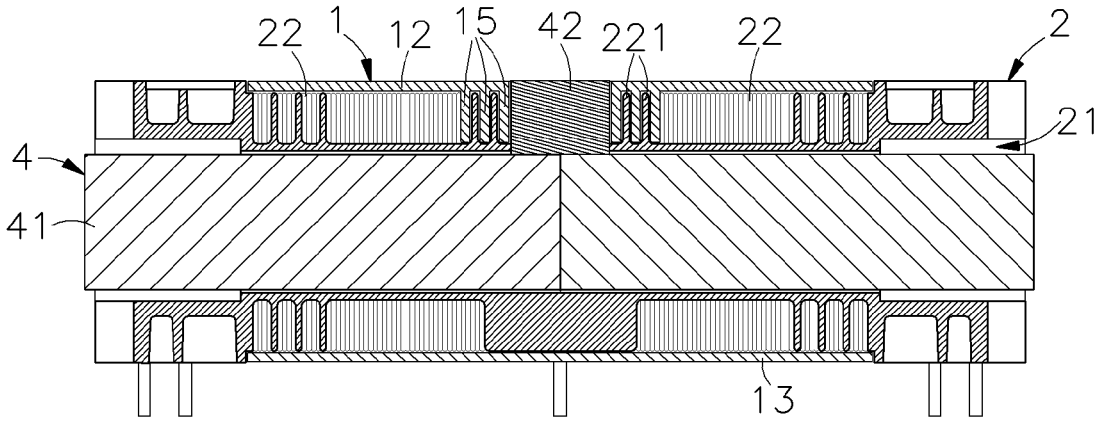
FIG. 4 is a schematic sectional view showing a status of use of the low magnetic leakage high voltage transformer according to the present invention (I).
Figure 5:
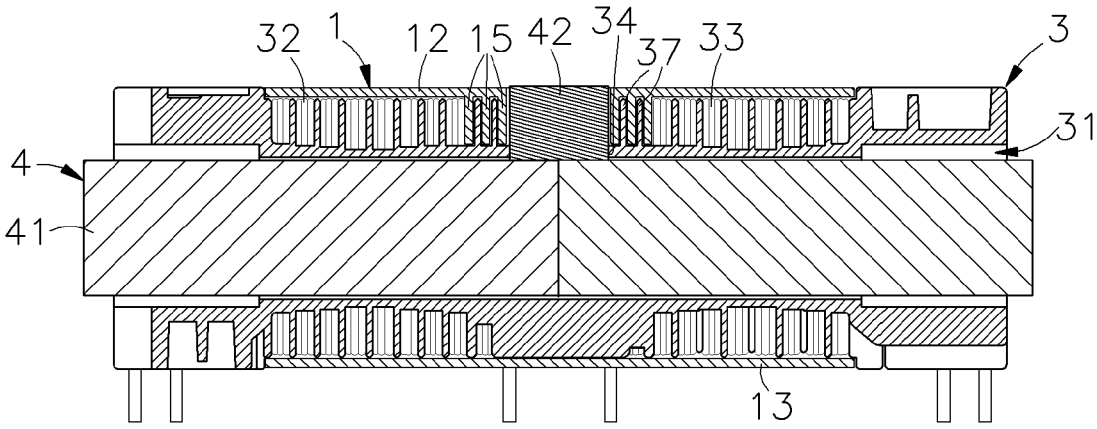
FIG. 5 is a schematic sectional view showing a status of use of the low magnetic leakage high voltage transformer according to the present invention (II).

Referring to FIGS. 4 and 5, during the assembly process of the low magnetic leakage high voltage transformer, the primary winding bracket 2 and the secondary winding bracket 3 are respectively inserted into the two receiving spaces 10 at two sides of the vertical middle wall 11 to keep the respective mounting slots 23 and 34 in communication with the insertion slot 14 of the electrically insulative holder frame 1 and the respective conducting terminals 25 and 36 suspending at two opposite lateral sides outside the electrically insulative holder frame 1, and simultaneously to force the coupling grooves 24 of the primary winding bracket 2 into engagement with the coupling flanges 35 of the secondary winding bracket 3. The two first FERRITE cores 41 are then respectively inserted into the insertion holes 21 and 31 of the primary winding bracket 2 and the secondary winding bracket 3 from two sides, and then the second FERRITE core 42 is inserted into the insertion slot 14 of the electrically insulative holder frame 1 and the mounting slots 23 and 34 of the primary winding bracket 2 and the secondary winding bracket 3 and stopped at the top side of the abutted distal ends of the two first FERRITE cores 41. At this time, the baffle flanges 15 of the electrically insulative holder frame 1 are engaged with the partition flanges 221 of the primary winding bracket 2 and the partition flanges 37 of the secondary winding bracket 3 to isolate the second FERRITE core 42 from the primary windings 22 and the secondary windings 32 and 33. The number and shape of the baffle flanges 15 are designed to engage with the partition flanges 221 and 37 so as to increase the creepage distance between the second FERRITE core 42 and the windings 22, 32 and 33, conforming to the safety code.

Referring to FIG. 3~5 again, when turned on the power supply (not shown), electric current goes through the conducting terminals 25 to the primary windings 22 and the secondary windings 32 and 33 and then goes out of the secondary windings 32 and 33 through the conducting terminals 36. By means of the induction of the magnetic path formed of the first FERRITE cores 41 and the second FERRITE core 42 with the secondary windings 32 and 33 at the secondary winding bracket 3, the voltage of the electric current that passes through the primary windings 22 and the secondary windings 32 and 33 is changed, i.e., boosted to the desired high voltage level. Because of the effect of the second FERRITE core 42, one single magnetic path is provided for the primary windings 22 and the secondary windings 32 and 33, preventing magnetic interference between the primary windings 22 and the secondary windings 32 and 33. Therefore, the output current is stable.

Figure 6:
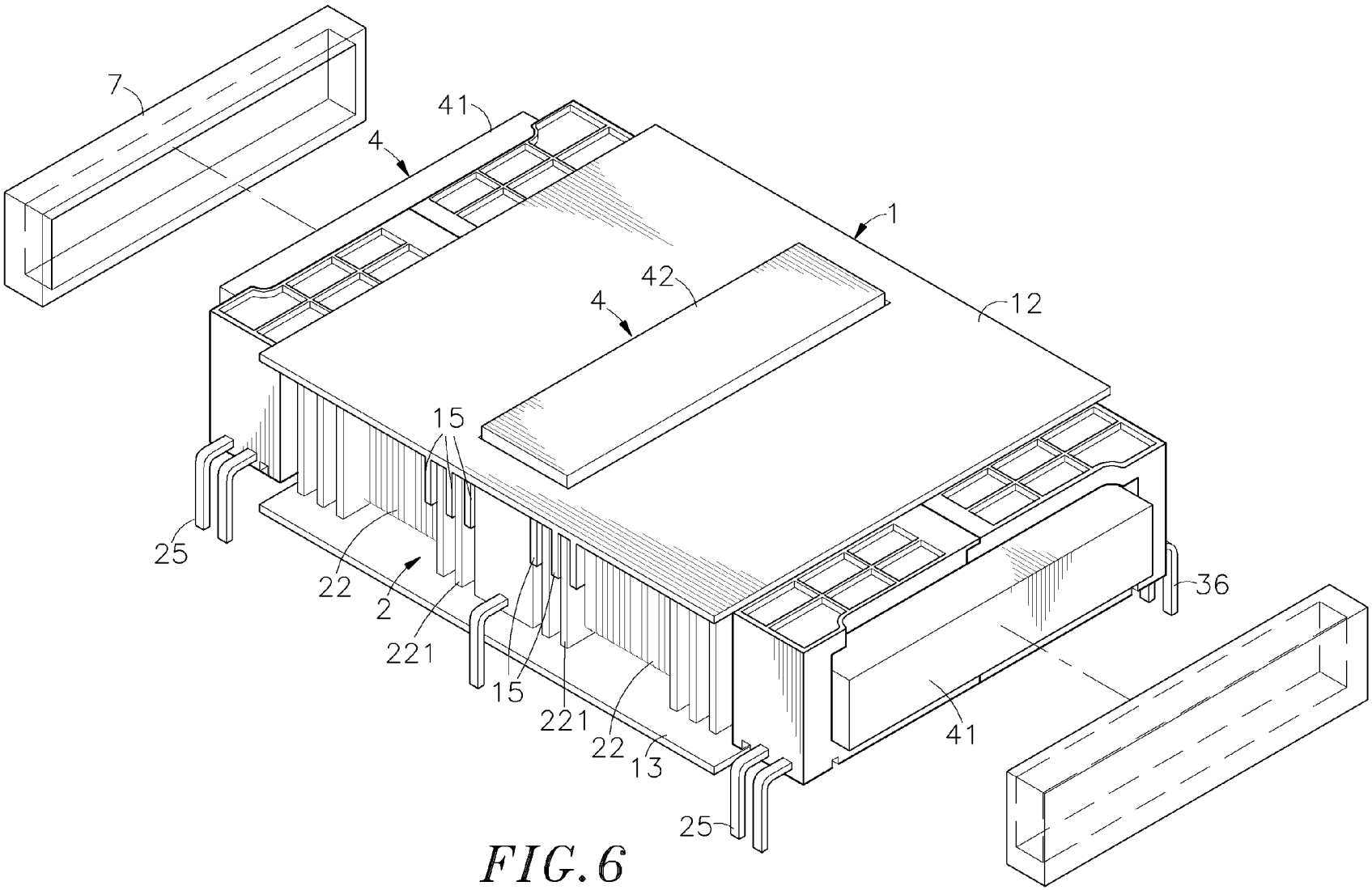
FIG. 6 is an elevational view of an alternate form of the low magnetic leakage high voltage transformer according to the present invention.
Figure 7:
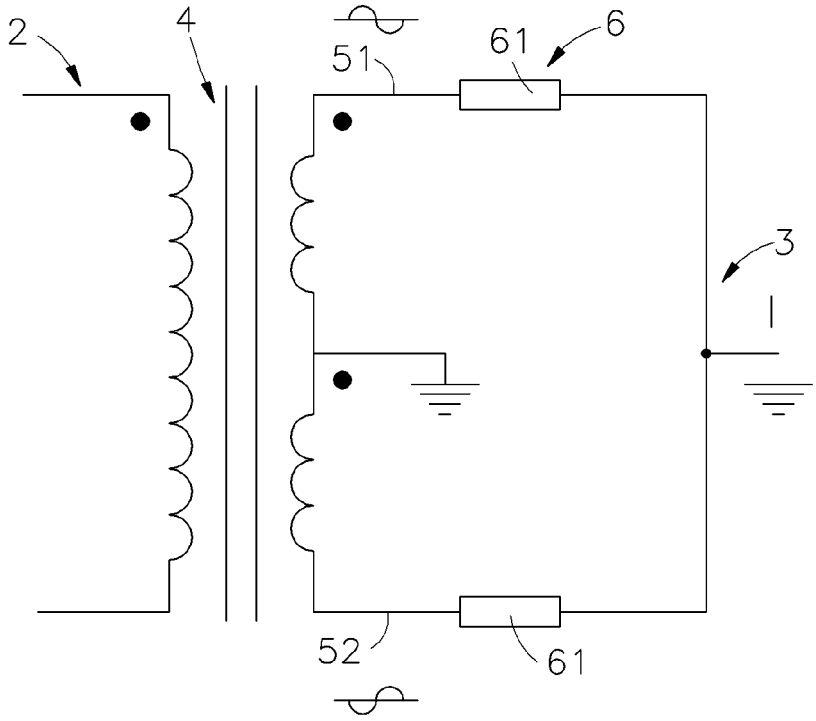
FIG. 7 is a diagram of a simple circuit of the low magnetic leakage high voltage transformer shown in FIGS. 1~5.
Figure 8:
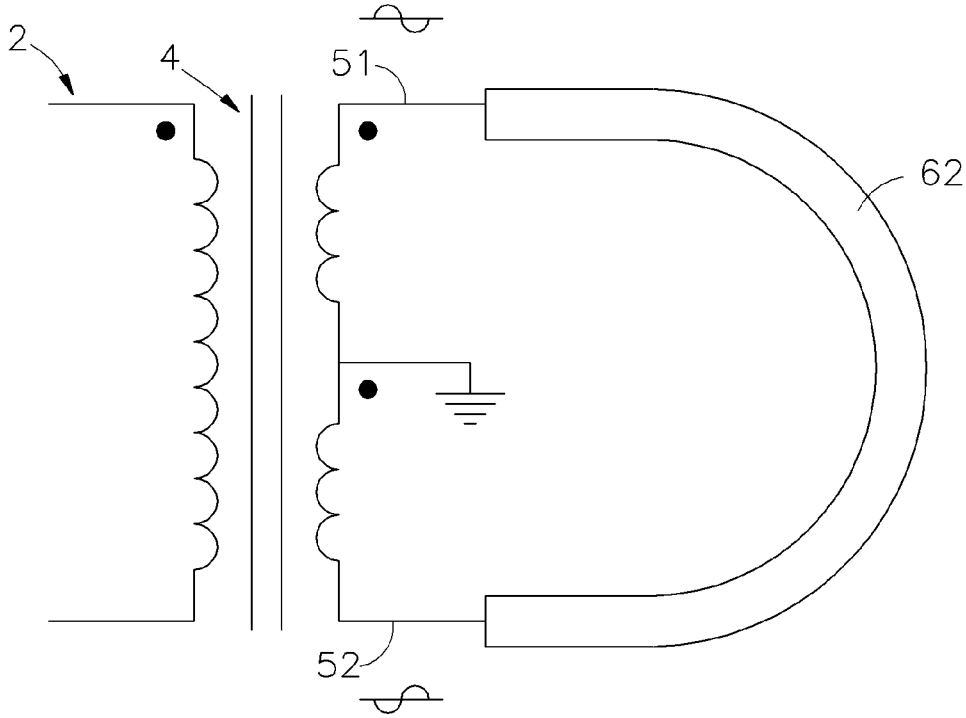
FIG. 8 is a diagram of a simple circuit of the low magnetic leakage high voltage transformer shown in FIG. 6.
Figure 9:
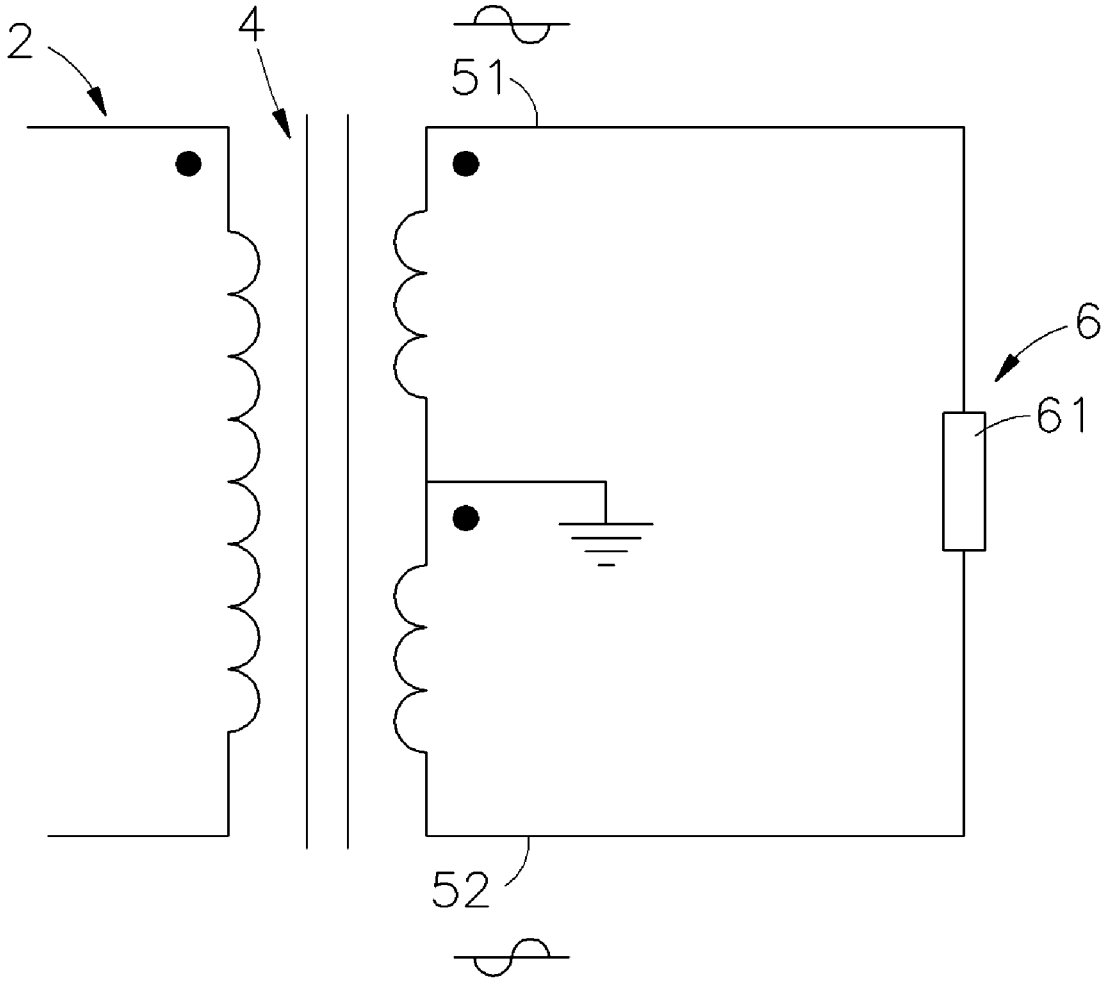
FIG. 9 is a diagram of a simple circuit of still another alternate form of the low magnetic leakage high voltage transformer according to the present invention.
Figure 10:
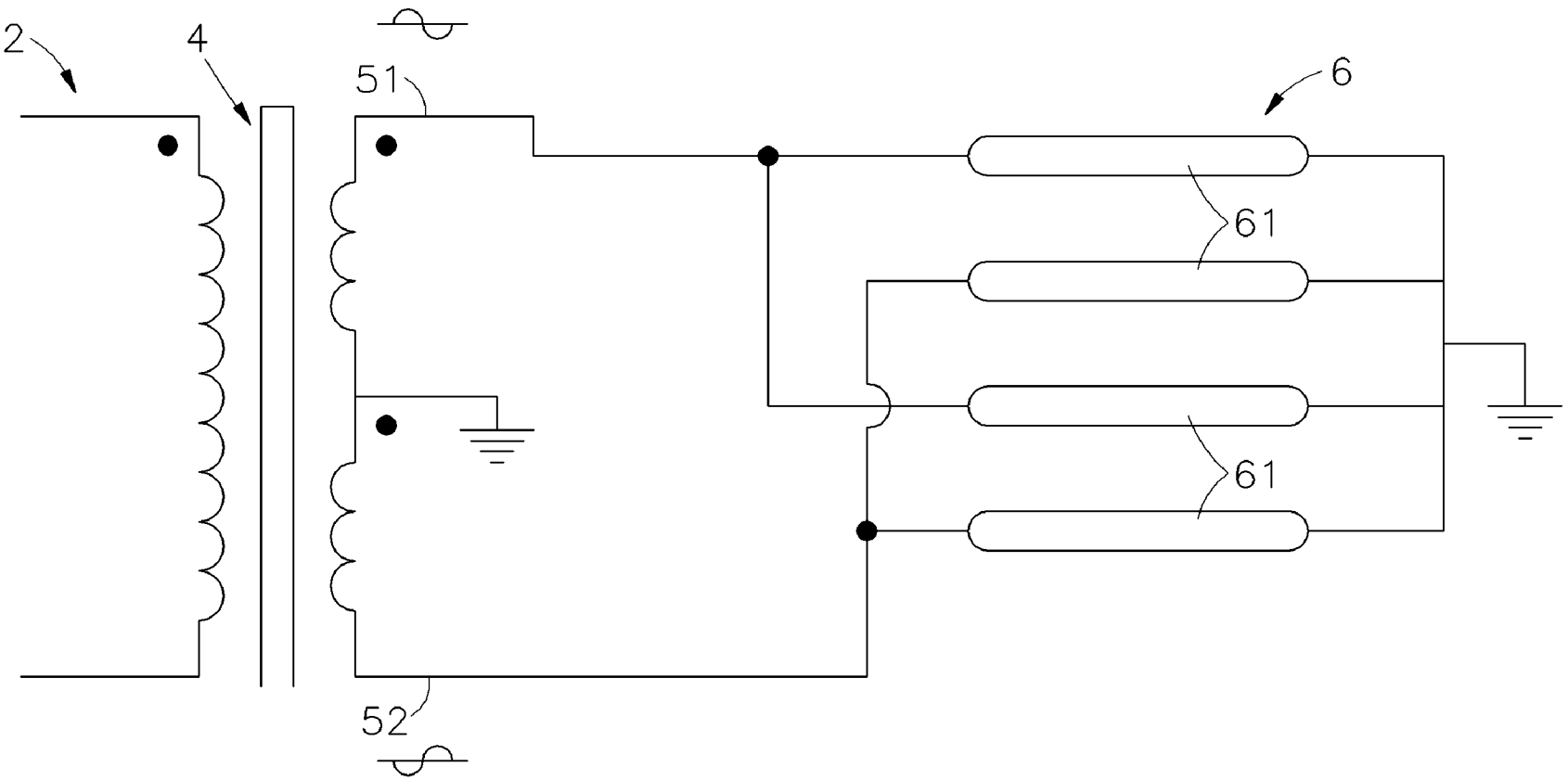
FIG. 10 is a diagram of a simple circuit of still another alternate form of the low magnetic leakage high voltage transformer according to the present invention.
Figure 11:
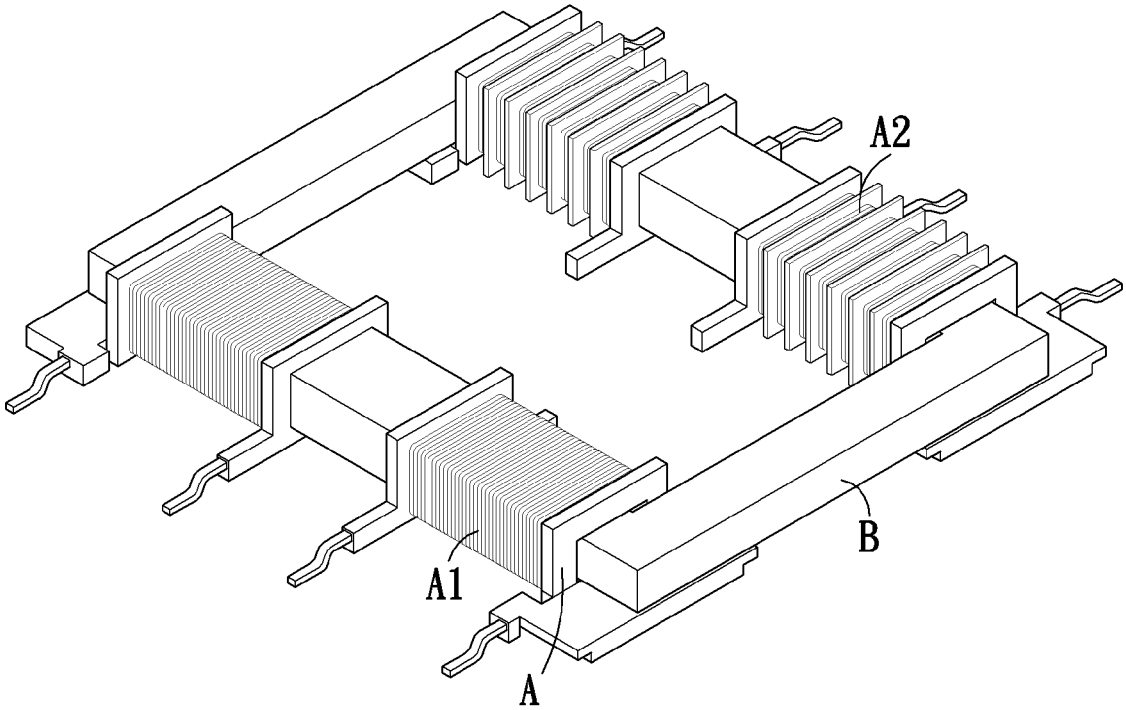
PRIOR ART FIG. 11
FIG. 11 is an exploded view of a high voltage transformer according to the prior art.

FIG. 6 shows an alternate form of the low magnetic leakage high voltage transformer according to the present invention. According to this embodiment, two electrically insulative caps 7 are respectively capped on the distal ends of the primary winding bracket 2 and the secondary winding bracket 3 and abutted against the front and back sides of the electrically insulative holder frame 1, increasing the creepage distance between the conducting terminals 25 and 36 and the first FERRITE cores 41.

Referring to FIGS. 7~10, the conducting terminals 25 of the primary windings 22 at the primary winding bracket 2 are electrically coupled to an external drive circuit (not shown) that provides a voltage (400V DC) to the primary windings 22. By means of the induction effect of the two secondary windings 32 and 33 at the secondary winding bracket 3, a positive high voltage 51 (2000V~2400V AC) and a negative high voltage 52 (2000V~2400V AC) are produced and outputted through the conducting terminals 36. The positive high voltage 51 and the negative high voltage 52 are respectively coupled to a load 6, driving the load 6 to work. By means of the effect of the baffle flanges 15 to increase the creepage distance between the FERRITE core and the windings, the low magnetic leakage high voltage transformer provides a voltage-resistant power.

The load(s) 6 to which the aforesaid positive high voltage 51 and the negative high voltage 52 are coupled can be one single straight lamp tube 61, U-shaped lamp tube 62 or a series of lamp tubes 61. By means of the induction of the two secondary windings 32 and 33 at the secondary winding bracket 3, the input voltage is caused to produce two high voltages (the positive high voltage 51 and the negative high voltage 52) for driving the load(s) 6. According to magnetic law, the magnetic flux and its direction produced between the FERRITE core set 4 and the primary windings 22 at the primary winding bracket 2 are same as that produced between the FERRITE core set 4 and the secondary windings 32 and 33 at the secondary winding bracket 3, therefore the electric current passing through the load(s) 6 is automatically kept in balance. Therefore, the low magnetic leakage high voltage transformer of the present invention can produce two output voltages to drive multiple loads 6, eliminating the problem of unstable or insufficient driving voltage.

Further, when the positive high voltage 51 and the negative high voltage 52 are respectively coupled to a respective end of multiple lamp tubes 61, the other ends of the lamp tubes 61 are grounded, and therefore the low magnetic leakage high voltage transformer can drive multiple lamp tubes 61.

By means of the aforesaid design, the primary windings 22 at the primary winding bracket 2 of the low magnetic leakage high voltage transformer is adapted for the input of an input voltage for causing the two secondary windings 32 and 33 at the secondary winding bracket 3 to output two high voltages for driving multiple loads 6 (either straight lamp tubes 61 or U-shaped lamp tubes 62). Therefore, the invention saves much the cost and installation space. Further, the use of the second FERRITE core 42 shortens the magnetic path and enhances transformer coupling, showing typical increase of leakage inductance to produce the desired resonance.

In general, the invention provides a low magnetic leakage high voltage transformer, which has the following features and advantages:

1. The invention uses an electrically insulative holder frame 1 to hold one primary winding bracket 2 with two primary windings 22 and one secondary winding bracket 3 with two secondary windings 32 and 33, and one FERRITE core set 4 to work with the primary windings 22 and the secondary windings 32 and 33 for producing two output voltages for driving multiple loads 6. The FERRITE core set 4 comprises two U-shaped first FERRITE cores 41, which are inserted into the primary winding bracket 2 and the secondary winding bracket 3 from two opposite sides and abutted against each other inside the primary winding bracket 2 and the secondary winding bracket 3, and a straight-shape second FERRITE core 42, which is inserted into an insertion slot 14 on the electrically insulative holder frame 1 to contact with the abutted first FERRITE cores 41. The electrically insulative holder frame 1 has baffle flanges 15 that increase the creepage distance between the second FERRITE core 42 and the windings 22, 32 and 33, enhancing the voltage-resistant power of the low magnetic leakage high voltage transformer and preventing an overheat or failure of the FERRITE core set. Therefore, the invention effectively stabilizes the electric current of the lamp tubes connected thereto, extending the working life of the lamp tubes.

2. The use of the straight-shape second FERRITE core 42 shortens the magnetic path and enhances transformer coupling, thereby increasing leakage inductance to produce the desired resonance.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A low magnetic leakage high voltage transformer comprising an electrically insulative holder frame, a primary winding bracket mounted in said electrically insulative holder frame at one side, a secondary winding bracket mounted in said electrically insulative holder frame at an opposite side, a plurality of primary windings wound on said primary winding bracket, a plurality of secondary windings wound on said secondary winding bracket, and an FERRITE core set mounted in said primary winding bracket and said secondary winding bracket for producing a magnetic field to induce an electric current going through said primary windings and said secondary windings, said FERRITE core set comprising two U-shaped FERRITE cores inserted into said primary winding bracket and said secondary winding bracket from two opposite sides and abutted against each other in said primary winding bracket and said secondary winding bracket, wherein said electrically insulative holder frame comprises an insertion slot on a top side thereof, and a plurality of baffle flanges downwardly extending from a top wall thereof at two sides of said insertion slot to isolate said FERRITE core set from said primary windings and said secondary windings; said primary winding bracket and said secondary winding bracket each have a partition flange and a mounting slot formed in said partition flange in communication with said insertion slot of said electrically insulative holder frame; said FERRITE core set comprises a straight FERRITE core inserted into said insertion slot of said electrically insulative holder frame and said mounting slots of said primary winding bracket and said secondary winding bracket and stopped between said baffle flanges of said electrically insulative holder frame within the partition flanges of said primary winding bracket and said secondary winding bracket and kept in contact with said U-shaped FERRITE cores.

2. The low magnetic leakage high voltage transformer as claimed in claim 1, wherein said electrically insulative holder frame is comprised of a vertical middle wall and a horizontal top wall and a horizontal bottom wall at top and bottom sides of said vertical middle wall, showing an I-shaped profile.

3. The low magnetic leakage high voltage transformer as claimed in claim 2, wherein said horizontal top wall and said horizontal bottom wall define two receiving spaces at two sides of said vertical middle wall for holding said primary winding bracket and said secondary winding bracket respectively.

4. The low magnetic leakage high voltage transformer as claimed in claim 1, wherein said primary winding bracket and said secondary winding bracket each have two opposite ends and an insertion hole extending through the two opposite ends for the mounting of said U-shaped FERRITE cores.

5. The low magnetic leakage high voltage transformer as claimed in claim 1, wherein said primary winding bracket has a plurality of coupling grooves disposed at two distal ends thereof; said secondary winding bracket has a plurality of coupling flanges disposed at two distal ends thereof and respectively coupled to said coupling grooves of said primary winding bracket.

6. The low magnetic leakage high voltage transformer as claimed in claim 1, wherein said FERRITE core set is made out of one of FERRITE series materials including manganese zinc and nickel zinc.

7. The low magnetic leakage high voltage transformer as claimed in claim 1, further comprising two electrically insulative caps capped on said primary winding bracket and said secondary winding bracket and abutted against two opposite sides of said electrically insulative holder frame.

* * * * *